US005954203A

United States Patent [19]

Marconi

[11] Patent Number: 5,954,203

[45] Date of Patent: Sep. 21, 1999

[54] PACKAGING CONTAINER

[75] Inventor: Lance Emilio Marconi, Chicago, Ill.

[73] Assignee: Allegiance Corporation, McGaw Park, Ill.

[21] Appl. No.: 08/998,128

[22] Filed: Dec. 24, 1997

[51] Int. Cl.[6] ..... B65D 73/00

[52] U.S. Cl. ..... 206/464; 206/591; 206/511; 206/807

[58] Field of Search ..... 206/464, 465, 206/470, 471, 521, 523, 591, 592, 594, 508, 511, 509, 364, 807, 723

[56] References Cited

U.S. PATENT DOCUMENTS

| | | | |
|---|---|---|---|
| 2,013,299 | 9/1935 | Byrne | 206/459.1 |
| 3,659,706 | 5/1972 | Serrell | 206/531 |
| 3,743,084 | 7/1973 | Douglas | 206/531 |
| 3,744,627 | 7/1973 | Rope et al. . | |
| 3,854,581 | 12/1974 | Jones, Jr. | 206/460 |
| 3,871,516 | 3/1975 | Holkestad et al. | 206/387 |
| 3,999,661 | 12/1976 | Jones . | |
| 4,241,829 | 12/1980 | Hardy . | |
| 4,340,141 | 7/1982 | Fischer | 206/531 |
| 4,512,474 | 4/1985 | Harding | 206/461 |
| 4,687,129 | 8/1987 | Cugley . | |
| 4,696,401 | 9/1987 | Wallace . | |
| 4,697,703 | 10/1987 | Will . | |
| 4,730,729 | 3/1988 | Mönch . | |
| 4,911,304 | 3/1990 | Bunin | 206/531 |
| 5,090,568 | 2/1992 | Tse | 206/456 |
| 5,178,282 | 1/1993 | Williams . | |
| 5,284,244 | 2/1994 | O'Toole et al. . | |
| 5,293,993 | 3/1994 | Yates, Jr. et al. | 206/470 |
| 5,320,226 | 6/1994 | Merrill | 206/521 |
| 5,353,929 | 10/1994 | Foster . | |
| 5,447,230 | 9/1995 | Gerondale . | |
| 5,507,389 | 4/1996 | Syrek | 206/508 |
| 5,540,324 | 7/1996 | Knapp | 206/6.1 |
| 5,554,097 | 9/1996 | Guy . | |
| 5,595,300 | 1/1997 | Paik et al. . | |
| 5,699,913 | 12/1997 | Richardson | 206/470 |
| 5,699,925 | 12/1997 | Petruzzi | 206/511 |

*Primary Examiner*—Paul T. Sewell
*Assistant Examiner*—Nhan T. Lam
*Attorney, Agent, or Firm*—Paul E. Schaafsma

[57] ABSTRACT

The present invention provides a clam shell packaging arrangement having a base 12 which defines a receiving area 23. A cover 14 is further provided which engages in a sealing snap fit arrangement with the base 12. The base 12 and the cover 14 are connected by an integral living hinge 16 which includes a first hinge element 18 connected to the base 12 and a second hinge element 20 connected to the cover 14. The bottom wall of the base 12 defines a plurality of upwardly extending integral plastic bubbles 57. The cover 14 defines a plurality of cooperating downwardly extending integral plastic bubbles 59. The bubbles 57, 59 are resilient enough to cradle a product and flexible enough to secure the product in its position.

54 Claims, 5 Drawing Sheets

PACKAGING CONTAINER

FIELD OF THE INVENTION

The present invention relates to packaging containers.

BACKGROUND OF THE INVENTION

In packaging products for shipment, it is frequently desirable to protect the product from damage which could be caused from bumps and bruises which are inherent in product shipment. It has become the practice to enclose products in oversized containers and include some type of packaging material, such as shredded paper, excelsior or styrofoam peanuts to provide protection for the product.

Another packaging procedure that has been employed is to enclose the product in an inner carton and place the carton in a second carton which makes up an outer protective barrier. Packaging material, such as shredded paper, excelsior or styrofoam peanuts surround the inner carton to provide protection for the product.

Yet another attempt to protect product shipment is to provide form-fitted compartment inserts within the packaging carton. Such packaging can consist of fitted styrofoam or plastic which specifically cradles a product being shipped to protect the product from damage.

Yet another attempt to protect products in shipping is the use of a foam egg carton inserts which are placed within the carton and cradle the product being shipped. Another attempt to protect products when shipping is to place the product between resilient membranes which act to suspend the product a distance from the walls of the shipping container thereby giving the protection desired.

The drawback of all of these packaging containers is that each adds considerably to the expense of packaging and therefore the expense of the product to consumers. For example, packaging which includes packaging material not only adds the expense of the packaging materials itself but also includes the added cost during manufacturing of placing the packaging material in the carton, placing the product on a bed of the packaging material, and filling the carton with the packaging material. The use of inner cartons within outer protective shells also entails the use of additional material as well as the additional manufacturing expense. The use of form fitted compartments inserts is expensive in that each package includes additional packaging materials which increases the cost of manufacturing such packaging containers as well as the cost of carrying in inventory large amounts of packaging containers to insure that sufficient quantities are in on hand for each different type of product shipped. Use of foam egg carton packaging entails not only the additional expense of the material itself but also the added cost of manufacturing or placing additional components which are inserted into the packaging carton.

What would be useful would be a package which provides support for and protection of the product during shipment. Such container would further be capable of protecting products of various sizes and shapes without the need to manufacture specifically different packaging or for each different product. Such container would achieve these benefits in a cost-efficient packaging environment.

SUMMARY OF THE INVENTION

The present invention provides a packaging container which provides support for and protection of the product during shipment. The present invention does not require use of packaging inserts, does not require use of multiple containers, does not require use of foam inserts, and does not require specific packaging orientation for different types of products. The present invention provides a universal packaging structure which can accommodate products of different sizes and shapes while providing the shipping protection required. The present invention provides all these benefits in a cost-effective packaging arrangement.

The present invention provides a clam shell packaging arrangement having a base which defines a receiving area. A cover is further provided which engages in a sealing snap fit arrangement with the base. The base and the cover are connected by an integral living hinge which includes a first hinge element connected to the base and a second hinge element connected to the cover. The bottom wall of the base defines a plurality of upwardly extending integral plastic bubbles. The cover defines a plurality of cooperating downwardly extending integral plastic bubbles. The bubbles are resilient enough to cradle the product and flexible enough to secure the product in its position.

DETAILED DESCRIPTION OF A PREFERRED EMBODIMENT

Figure 1:
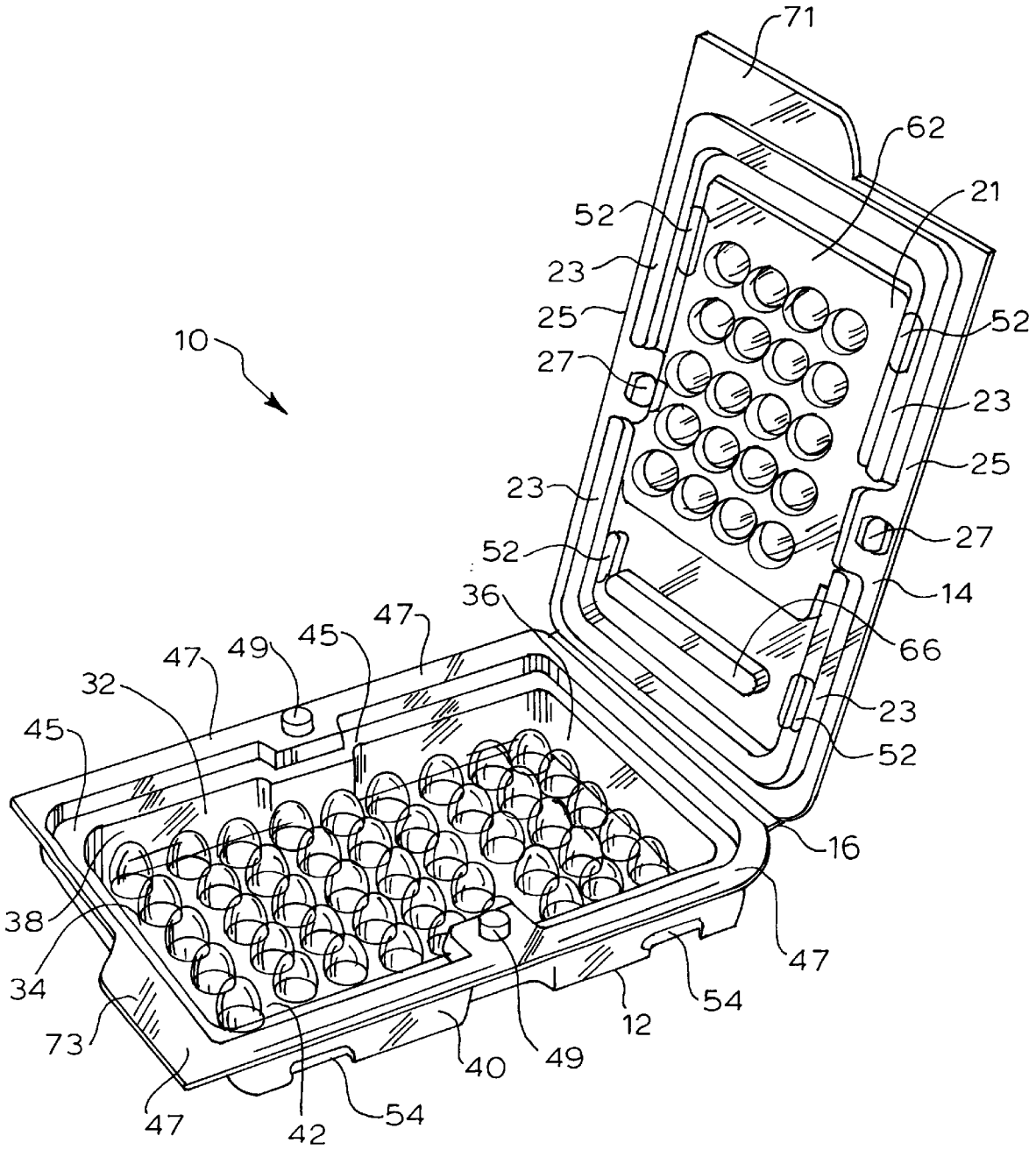
FIG. 1 is an open perspective view of a packaging container made in accordance with the principles of the present invention.
Figure 2:
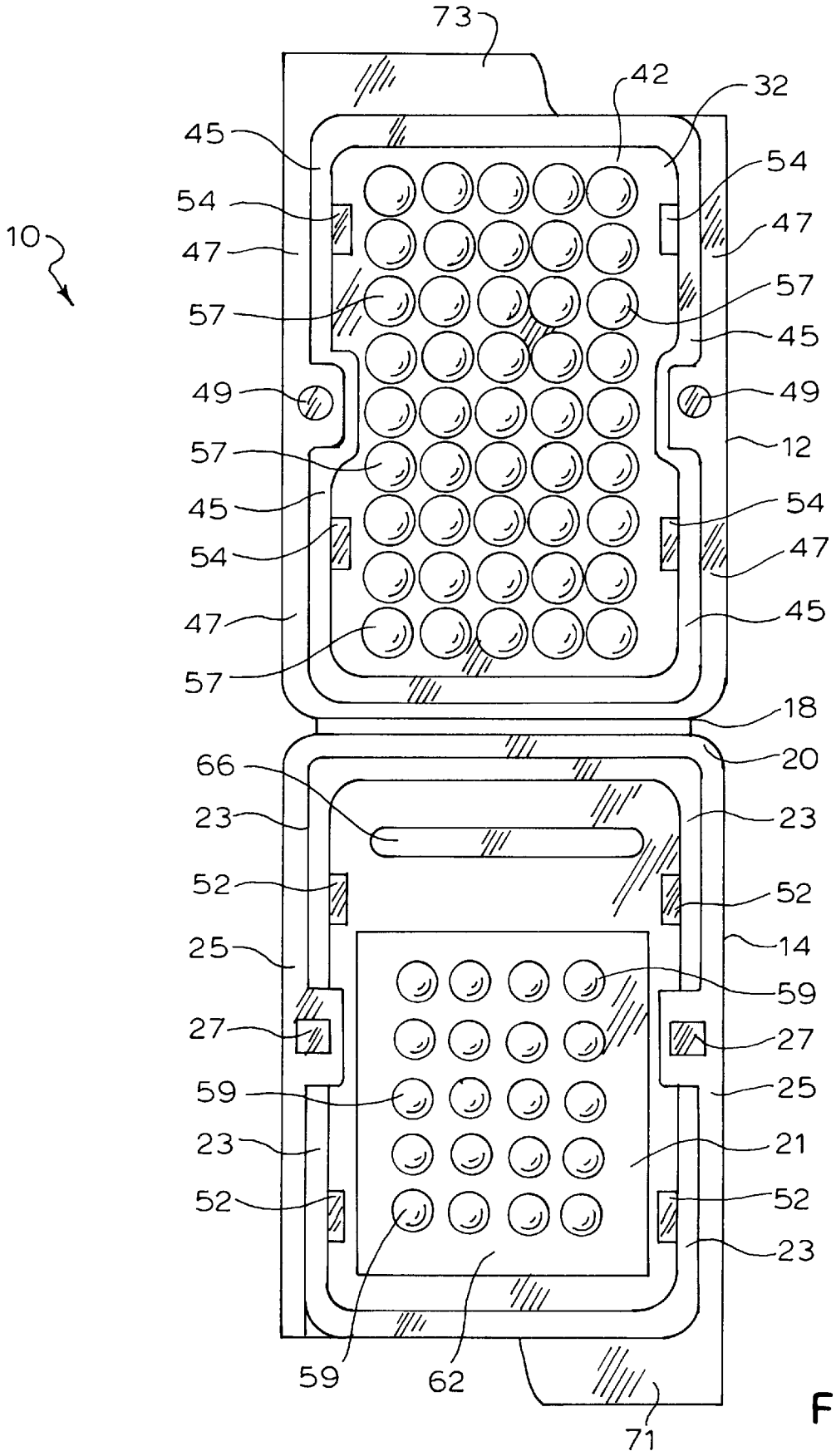
FIG. 2 is an open plan view of the packaging container of FIG. 1.

Referring first to FIG. 1, a packaging container made in accordance with the principles of the present invention is generally designated by the numeral 10. The packaging container 10 includes a base 12 and a cover 14. The base 12 is connected to the cover 14 by use of an integral living hinge 16. As best seen in FIG. 2, the integral living hinge 16 consists of a first hinge portion 18 connected to the base 12 and a second hinge portion 20 connected to the cover 14 and to the first hinge portion 18. Use of the double-hinged living hinge 16 ensures the cover 14 is secured to the base 12 in an even downward engagement.

Contained on the cover 14 is a recessed label area 21 which is sized to accept a label 64. The cover 14 defines an upwardly extending projection 23 which surrounds the periphery of the label area 21. Extending outwardly from the upwardly extending projection is a flange 25. Downwardly extending square shaped recesses 27 are provided on the cover 14 at approximately the mid-point of each side.

The base 12 includes a receiving area 32 for receiving products. The receiving area 32 is defined by a first end wall 34, a second end wall 36, a first side wall 38, a second side wall 40, and a bottom wall 42. Extending outwardly from the receiving area is a stepped portion 45. At the upper periphery of the stepped portion 45 is an outwardly extending flange 47. The stepped portion 45 cooperatively mates with the upwardly extending projection 23 of the cover 14 to provide a frictional snap fit sealing engagement between the cover 14 and the base 12. Additionally contained on the outwardly extending flange 25 of the base 12 are a pair of upwardly extending circular shaped tabs 49. The upwardly extending tabs 49 frictionally engage or mate with the downwardly extending recesses 27 of the cover 14 in cooperating relationship to provide a further reinforcing frictional snap fit.

Figure 6:
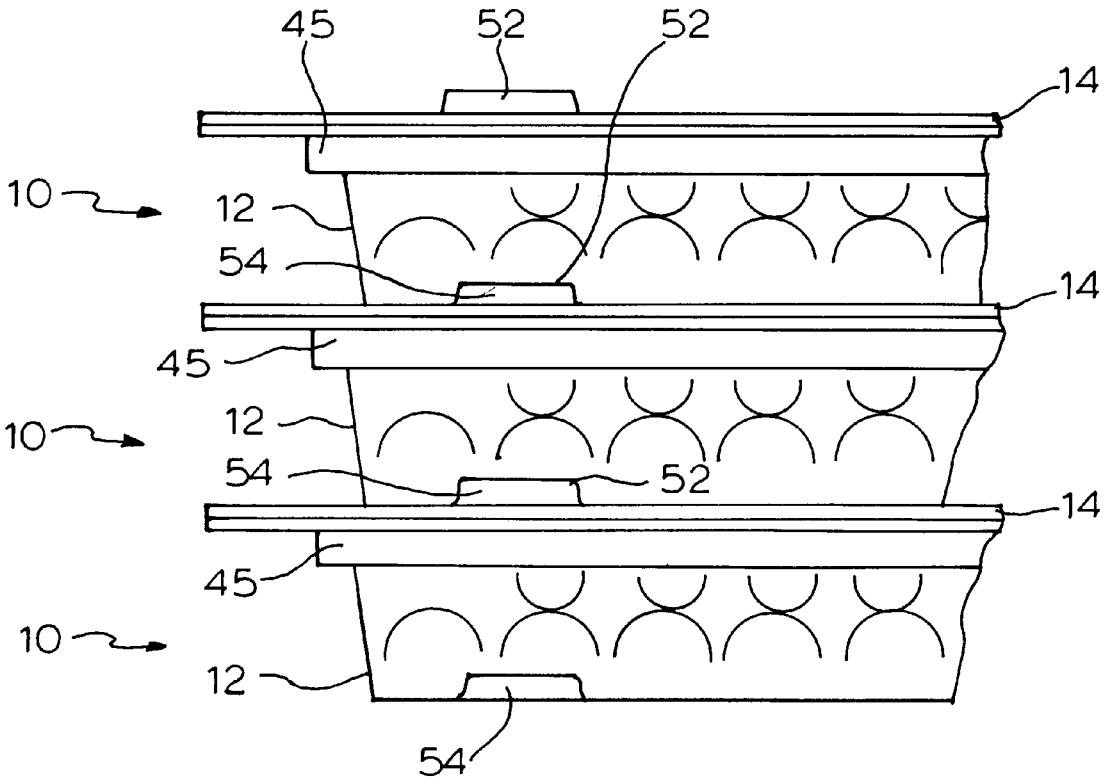
FIG. 6 is a perspective view of a plurality of the packaging containers of FIG. 1 stacked in a closed position.

The outwardly facing side of the cover 14 includes four leg portions 52. The outwardly facing side of the base 12 includes four recessed areas 54. When the packaging containers 10 are in a closed position, the recessed areas 54 of the base act 12 in a cooperative relationship with the leg portions 52 of the cover 12 to stack a plurality of packaging containers 10 on top of each other. This is seen in FIG. 6.

The container is preferably made of a clear plastic material which enables easy viewing of the contents of the container. In the preferred embodiment described herein, the packaging material is made from an extruded sheet of Rexstar™ PETG 6763 plastic produced from Eastar PETG 6763 resin supplied by the Eastman Chemical Company of Kingsport, Tenn. Of course, comparable alternative materials are considered to be within the scope of the invention. The package is preferably formed by injection molding.

The sides of the receiving area 32 are slightly slanted inward in a draft design to enable nesting of the packaging containers 10 in the open position. Likewise, the sides of the upwardly extending protrusion 23 and of the stepped portion 45 also slightly slant inward in a draft design to enable nesting of the packaging containers 10 in the open position during shipment.

Contained on the bottom wall 42 of the receiving area 32 are a plurality of upwardly extending plastic bubbles 57. The plastic bubbles 57 are formed integrally with the base 12. The upwardly extending bubbles 57 are positioned so as to essentially comprise the bottom surface of the receiving area 32. The upwardly extending bubbles 57 are formed at a thickness which is resilient enough to give under the force of pressure when an instrument is packaged in the packaging container 10 to cradle the instrument, but sufficiently rigid to secure the instrument in place once the orientation of the instrument within the plurality of bubbles 57 has been established. To provide appropriate strength, the bubbles 57 decrease in thickness as the bubble rise above the receiving area towards the cover. In order to enable stacking of the empty open packages during shipment, each bubble 57 is tapered slightly inwardly in a draft design.

Contained on the cover 14 are a plurality of downwardly extending plastic bubbles 59. Like the bubbles 57 of the receiving area 32, the bubbles 59 of the cover 14 are formed integrally with the cover 14. Like the bubbles 57 formed in the receiving area 32, the bubbles 59 formed on the cover 14 are of a sufficient resiliency to give under the force of pressure when the cover 14 is closed on an instrument 60 to cradle the instrument 60, but also of sufficient rigidity to secure the instrument 60 once the orientation of the instrument 60 has been established. Additionally, like the bubbles 57 in the receiving area 32, the thickness of the bubble 59 decreases as the bubble 59 falls below the cover 14 towards the base 12. Like the bubbles 57 in the receiving area 32, each bubble 59 on the cover 14 is tapered slightly inwardly in a draft design.

Figure 5:
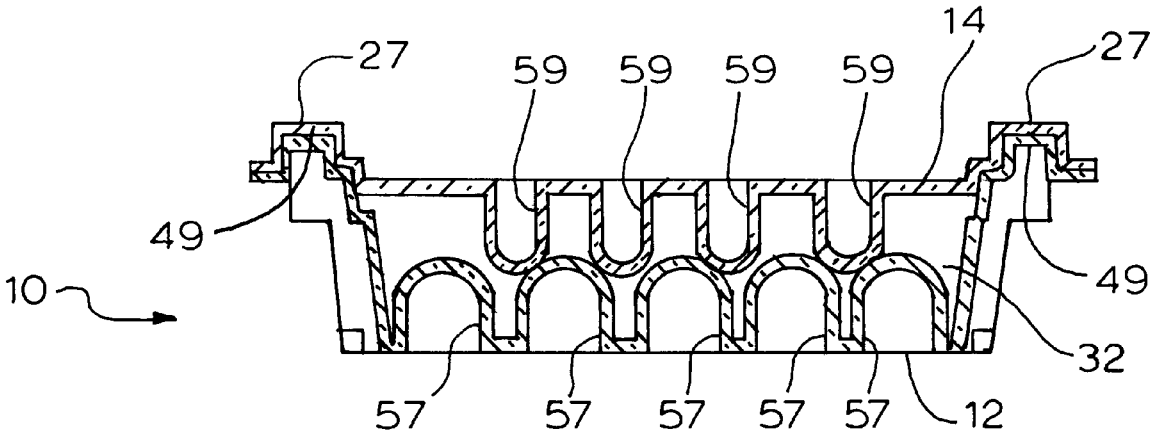
FIG. 5 is a cross-sectional view of the packaging container of FIG. 1.

While the bubbles 57 of the receiving area 32 are arranged so as to generally encompass the entire bottom surface, the bubbles 59 on the cover 14 are positioned in a cooperative relationship with the bubbles 57 on the receiving area 32. In particular, referring to FIG. 5, the bubbles 59 of the cover 14 are positioned to extend downwardly between the upwardly extending bubbles 57 of the receiving area 32. The height of the bubbles 57 which extend upwardly from the bottom surface of the receiving area 32 and the depth of the bubbles 59 which extend downwardly from the cover 14 are sized such that the downwardly extending bubbles 59 lightly contact the surface of the upwardly extending bubbles 57 when the packaging container 10 is in a closed position. Thus, an overlap between the upwardly extending bubbles 57 and the downwardly extending bubbles 59 is achieved. This overlap insures that the instrument packaged in the packaging container 10 will be cradled by the combination of the upwardly extending lower bubbles 57 and the downwardly extending upper bubbles 59.

In addition, in the preferred embodiment the resiliency of the upwardly extending bubbles 57 in the receiving area 32 and the downwardly extending bubbles 59 of the cover 14 are approximately equal. Because in the preferred embodiment the downwardly extending bubbles 59 of the cover 14 are smaller than the upwardly extending bubbles 57 of the receiving area 32, so as to "fit" between the upwardly extending bubbles 57, this approximately equal resiliency of the bubbles 57, 59 is achieved by using different technical formatting.

While the present invention contemplates use of the downwardly extending bubbles 59 on the cover 14 across the entire surface of the cover 14, in the preferred embodiment the bubbles 59 extend across only a portion of the cover 14. Additionally, the bubbles 59 are formed in the recess label area 21 of the cover 14. Surrounding the bubbles 59 in the recessed label area is a substantial flat portion 62. Use of the substantial flat portion 62 enables an adhesive paper label 64 to be placed on the packaging container 10 which completely covers the bubbles 59. This further reinforces the strength of the labeling and avoid possible breakage of the label 64 which could occur were the bubbles 59 positioned too close to the outer edges of the label 64.

In the preferred embodiment, the cover 14 includes not only the downwardly extending bubbles 59 but as well an enforcing ridge 66. The ridge 66 provides several functions. Initially, the ridge 66 adds strength and rigidity to the cover 14 and thus to the packaging container 10. Additionally, the ridge 66 defines two compartmental areas within the receiving cover 32. The first compartment area 68 is defined by the upwardly extending bubbles 57 and the downwardly extending bubbles 59. The second compartment area 70 is defined by the upwardly extending bubbles 57 and the downwardly extending ridge 66. This can be useful when, for example, an instrument includes areas with larger circumferential widths, such as a handle. In packaging such instruments, it has been found that positioning a portion of the instrument by the upwardly extending bubbles 57 of the receiving area 32 and the downwardly extending bubbles 59 of the cover 14 is sufficient to cradle and secure the instrument in the packaging container 10.

Figure 3:
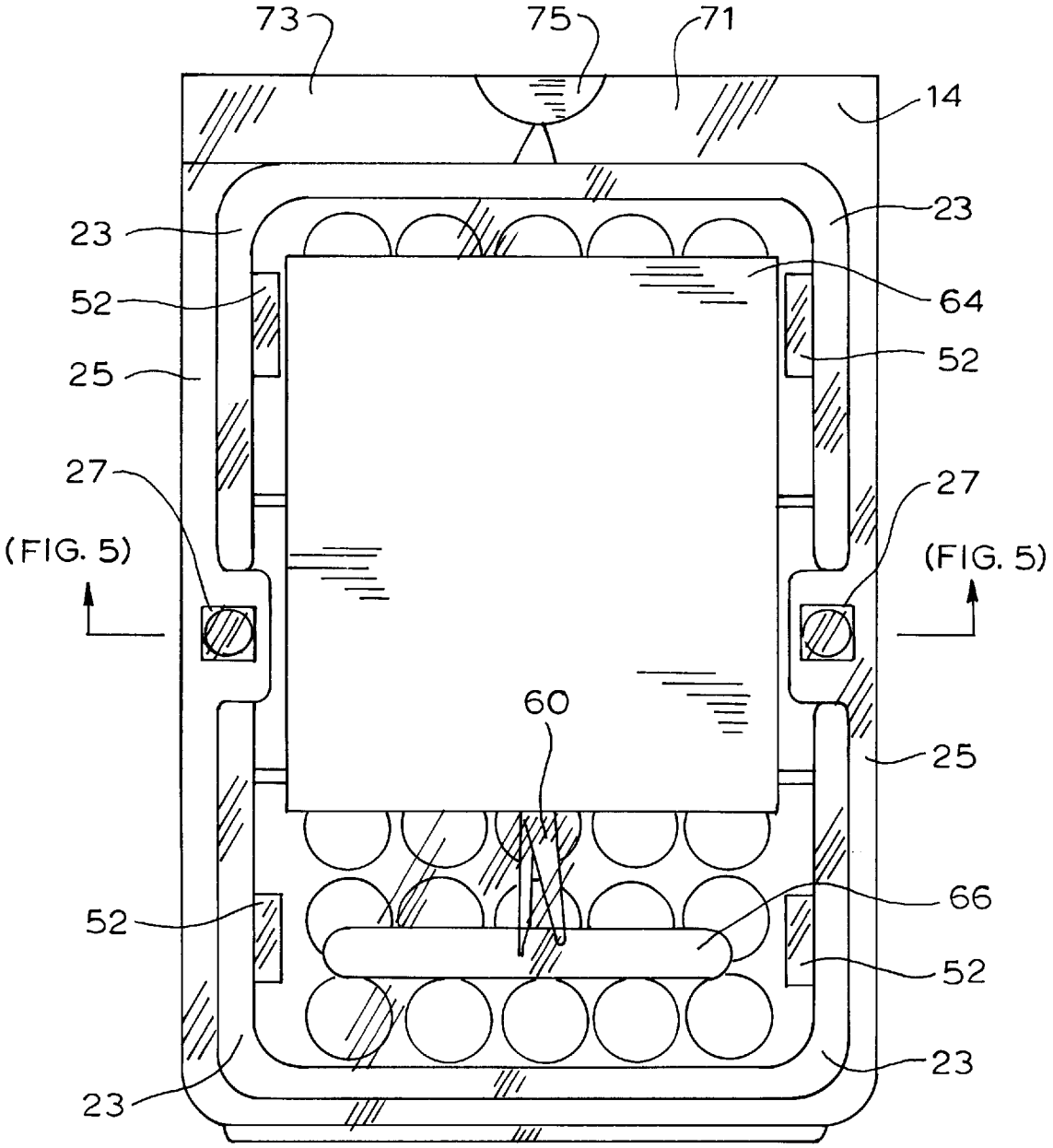
FIG. 3 is a closed plan view of the front of the packaging container of FIG. 1 with a surgical instrument and label.
Figure 4:
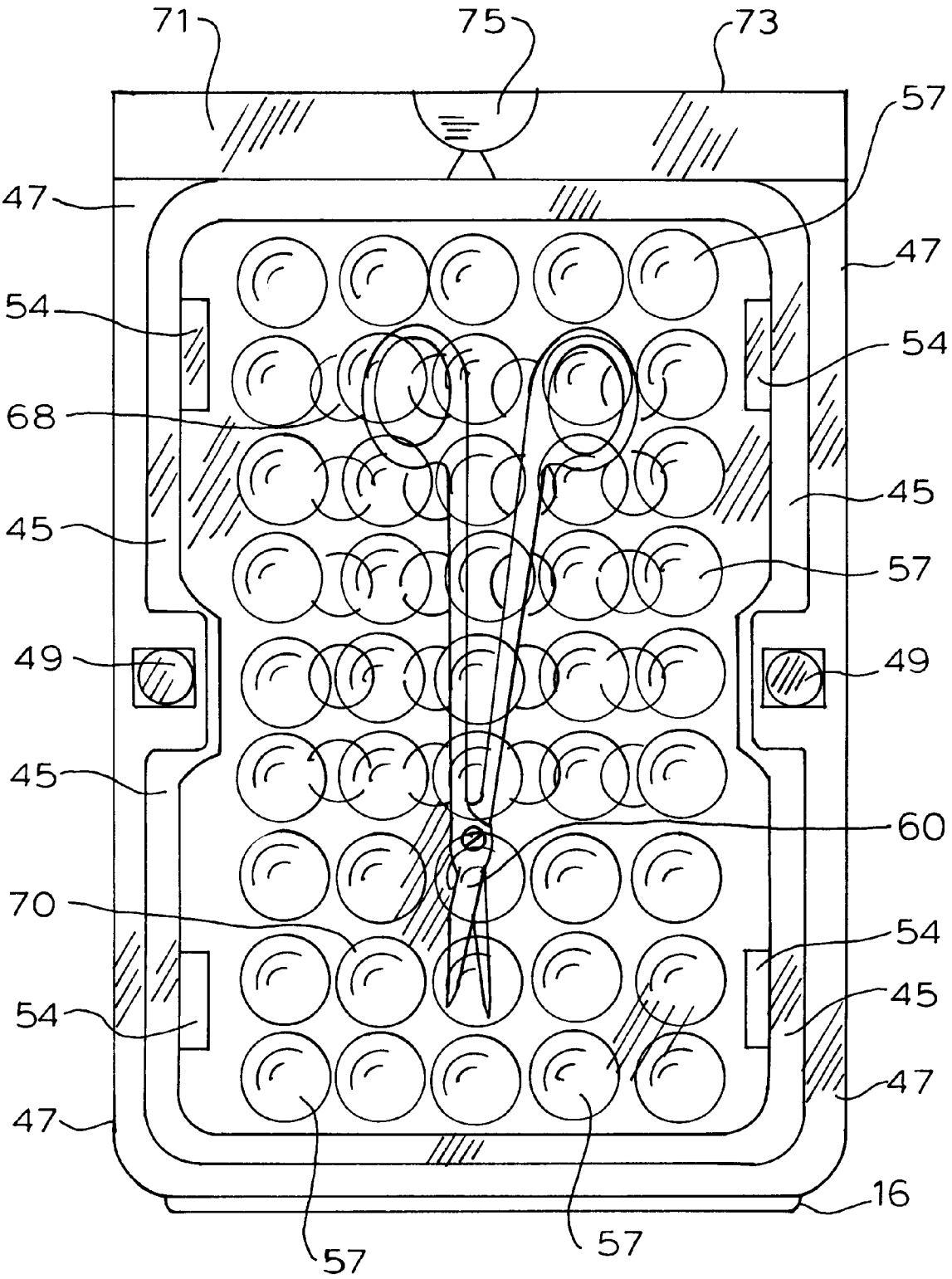
FIG. 4 is a closed plan view of the back of the packaging container of FIG. 1 having an instrument packaged therein.

Referring to FIGS. 3 and 4, means for sealing the packaging container 10 in a closed position are described. The outwardly extending flange 25 of the cover 14 defines a tab 71 across a portion of the end of the cover 14. The outwardly extending flange 47 of the base 12 defines a cooperating tab across a portion of the end 34 of the base 14. When in the closed, sealed position, a tamper seal 75 is secured over the junction of the tab 71 of the cover 14 and the tab 73 of the base, thus securing the packaging container 10 in the closed position. To open, the user simply grabs the cooperating tabs 71, 73 and pulls open thereby breaking the tamper seal 75.

It should be understood that various changes and modifications to the preferred embodiment described herein will be apparent to those skilled in the art. Such changes and modifications can be made without departing from the spirit and scope of the present invention and without diminishing its attendant advantages. It is therefore intended that such changes and modifications be covered by the appended claims.

What is claimed is:

1. A container for packaging a product, comprising:

a base having a plurality of upwardly extending bubbles defined therein;

a cover having a plurality of downwardly extending bubbles defined therein; and the upwardly extending bubbles and downwardly extending bubbles being sized to overlap in a horizontal plane upon closure of the base and the cover;

such that the upwardly extending bubbles cooperate with the downwardly extending bubbles to cradle the product.

2. The container of claim 1 wherein the base defines a receiving area having a bottom wall and the plurality of upwardly extending bubbles comprise the bottom wall.

3. The container of claim 1 wherein the cover defines a first area having the plurality of downwardly extending bubbles defined therein and a second area having a reinforcing ridge defined therein.

4. The container of claim 1 wherein the upwardly extending bubbles are formed integrally in the base.

5. The container of claim 4 wherein the downwardly extending bubbles are formed integrally in the cover.

6. The container of claim 1 wherein the upwardly extending bubbles are formed at a thickness which is resilient enough to cradle the product but sufficiently rigid to secure the product in place.

7. The container of claim 6 wherein the downwardly extending bubbles are formed at a thickness which is resilient enough to cradle the product but sufficiently rigid to secure the product in place.

8. The container of claim 1 wherein the upwardly extending bubbles are sized larger than the downwardly extending bubbles.

9. The container of claim 8 wherein the upwardly extending bubbles and the downwardly extending bubbles are of substantially equal resiliency.

10. The container of claim 1 further including a downwardly extending projection defined on the cover which cooperatively snap-fits with a stepped portion defined on the base.

11. This container of claim 10 further including a pair of upwardly extending substantially circular shaped tabs defined on the base which cooperatively snap-fit with a pair of substantially square shaped recesses defined on the cover.

12. The container of claim 1 further wherein the container is made of a clear material.

13. The container of claim 1 further including a tamper seal for sealing the container.

14. The container of claim 1 further including an integral hinge pivotally connecting the base and the cover.

15. The container of claim 1 further including an integral hinge pivotally connecting the base and the cover.

16. A container for packaging a product, comprising:

a base having a plurality of upwardly extending bubbles defined therein;

a cover having a downwardly extending projection defined therein;

the upwardly extending bubbles and downwardly extending projection being sized to overlap in a horizontal plane upon closure of the base and the cover; and a hinge pivotally connecting the base and the cover;

such that upon closure of the base and the cover the upwardly extending bubbles cooperate with the downwardly extending projection to cradle the product.

17. The container of claim 15 wherein the base defines a receiving area having a bottom wall and the plurality of upwardly extending bubbles comprise the bottom wall.

18. The container of claim 15 wherein the downwardly extending projection comprises a plurality of bubbles.

19. The container of claim 17 wherein the cover defines a first area having the plurality of downwardly extending bubbles defined therein and a second area having a reinforcing ridge defined therein.

20. The container of claim 18 wherein the upwardly extending bubbles and the downwardly extending projection are of substantially equal resiliency.

21. The container of claim 15 wherein the upwardly extending bubbles are formed integrally in the base.

22. The container of claim 21 wherein the downwardly extending projection is formed integrally in the cover.

23. The container of claim 15 wherein the upwardly extending bubbles are formed at a thickness which is resilient enough to cradle the product but sufficiently rigid to secure the product in place.

24. The container of claim 23 wherein the downwardly extending projection is comprised of bubbles which are formed at a thickness which is resilient enough to cradle the product but sufficiently rigid to secure the product in place.

25. The container of claim 15 wherein the upwardly extending bubbles are sized larger than the downwardly extending projection.

26. The container of claim 15 further including a downwardly extending projection defined on the cover which cooperatively snap-fits with a stepped portion defined on the base.

27. This container of claim 26 further including a pair of upwardly extending substantially circular shaped tabs defined on the base which cooperatively snap-fit with a pair of substantially square shaped recesses defined on the cover.

28. The container of claim 15 further wherein the container is made of a clear material.

29. The container of claim 2 further including a tamper seal for sealing the container.

30. A container for packaging a product, comprising:

a base having a plurality of upwardly extending bubbles defined therein;

a cover having a plurality of downwardly extending bubbles defined therein;

the upwardly extending bubbles and downwardly extending bubbles being sized to overlap in a horizontal plane upon closure of the base and the cover;

a hinge pivotally connecting the base and the cover; and a tamper seal;

such that the upwardly extending bubbles cooperate with the downwardly extending bubbles to cradle the product.

31. The container of claim 30 wherein the base defines a receiving area having a bottom wall and the plurality of upwardly extending bubbles comprise the bottom wall.

32. The container of claim 30 wherein the cover defines a first area having the plurality of downwardly extending bubbles defined therein and a second area having a reinforcing ridge defined therein.

33. The container of claim 30 wherein the upwardly extending bubbles are formed integrally in the base.

34. The container of claim 33 wherein the downwardly extending bubbles are formed integrally in the cover.

35. The container of claim 30 wherein the upwardly extending bubbles are formed at a thickness which is resilient enough to cradle the product but sufficiently rigid to secure the product in place.

36. The container of claim 35 wherein the downwardly extending bubbles are formed at a thickness which is resilient enough to cradle the product but sufficiently rigid to secure the product in place.

37. The container of claim 30 wherein the upwardly extending bubbles are sized larger than the downwardly extending bubbles.

38. The container of claim 37 wherein the upwardly extending bubbles and the downwardly extending bubbles are of substantially equal resiliency.

39. The container of claim 30 further including a downwardly extending projection defined on the cover which cooperatively snap-fits with a stepped portion defined on the base.

40. This container of claim 39 further including a pair of upwardly extending substantially circular shaped tabs defined on the base which cooperatively snap-fit with a pair of substantially square shaped recesses defined on the cover.

41. The container of claim 30 further wherein the container is made of a clear material.

42. The container of claim 30 further wherein the base includes an outwardly extending tab, the cover defines a cooperating outwardly extending tab, and the means for sealing the container in a tamper evident closed position comprises a tamper seal which secures the cooperating tabs.

43. A container for packaging a product, comprising:

a base having a plurality of upwardly extending bubbles defined therein;

a cover having a plurality of downwardly extending bubbles defined therein;

the upwardly extending bubbles and downwardly extending bubbles being formed at a thickness which is resilient enough to give under pressure but sufficiently rigid to secure the product;

such that upon closure of the base and the cover the upwardly extending bubbles and downwardly extending bubbles cooperate with each other to cradle the product and wherein upon closure of the base and the cover the upwardly extending bubbles and the downwardly extending bubbles overlap in a horizontal plane in the absence of the product.

44. The container of claim 43 wherein the upwardly extending bubbles and the downwardly extending bubbles contact each other.

45. The container of claim 43 wherein the base defines a receiving area having a bottom wall and the plurality of upwardly extending bubbles comprise the bottom wall.

46. The container of claim 43 wherein the cover defines a first area having the plurality of downwardly extending bubbles defined therein and a second area having a reinforcing ridge defined therein.

47. The container of claim 43 wherein the upwardly extending bubbles are formed integrally in the base.

48. The container of claim 47 wherein the downwardly extending bubbles are formed integrally in the cover.

49. The container of claim 43 wherein the upwardly extending bubbles are sized larger than the downwardly extending bubbles.

50. The container of claim 49 wherein the upwardly extending bubbles and the downwardly extending bubbles are of substantially equal resiliency.

51. The container of claim 43 further including a downwardly extending projection defined on the cover which cooperatively snap-fits with a stepped portion defined on the base.

52. This container of claim 51 further including a pair of upwardly extending substantially circular shaped tabs defined on the base which cooperatively snap-fit with a pair of downwardly extending substantially square shaped recesses defined on the cover.

53. The container of claim 43 further wherein the container is made of a clear material.

54. The container of claim 43 further including a tamper seal for sealing the container.

* * * * *